United States Patent [19]

Vrtaric

[11] 4,254,324

[45] Mar. 3, 1981

[54] HAIR SINGER AND HAIR DRYER

[76] Inventor: John Vrtaric, 501 Linden Ave., Woodbridge, N.J. 07095

[21] Appl. No.: 952,498

[22] Filed: Oct. 18, 1978

[51] Int. Cl.[3] ..... A45D 20/08; A45D 20/50

[52] U.S. Cl. ..... 219/361; 219/223; 219/370; 219/371; 219/376; 34/98; 132/7; 132/112

[58] Field of Search ..... 219/361, 221, 223, 233, 219/201, 367-382; 132/7, 9, 11, 112; 30/140; 83/170, 171, 15, 16; 128/303.14, 303.1; 34/96-100, 3

[56] References Cited

U.S. PATENT DOCUMENTS

| | | | |
|---|---|---|---|
| 743,893 | 11/1903 | Lancaster . | |
| 975,073 | 11/1910 | Roberts et al. . | |
| 1,020,439 | 3/1912 | Norwood . | |
| 1,054,520 | 2/1913 | Eldridge | 219/223 |
| 1,366,196 | 1/1921 | McMahon . | |
| 1,370,524 | 3/1921 | Dumaine . | |
| 1,509,367 | 9/1924 | Miller | 219/376 |
| 1,525,106 | 2/1925 | Smythe | 132/112 |
| 1,770,749 | 7/1930 | Engberg et al. | 132/112 |
| 1,928,242 | 9/1933 | Baynham . | |
| 2,471,019 | 5/1949 | Baker . | |
| 2,491,708 | 12/1949 | Bradley | 219/223 |
| 2,577,839 | 12/1951 | Boax | 219/223 |
| 2,616,120 | 11/1952 | Erling | 132/112 |
| 2,727,132 | 12/1955 | Hills . | |
| 3,474,224 | 10/1969 | Carter . | |

FOREIGN PATENT DOCUMENTS

| | | | |
|---|---|---|---|
| 68899 | 3/1949 | Denmark | 219/223 |
| 1103299 | 11/1955 | France | 219/361 |
| 112181 | 1/1918 | United Kingdom | 219/371 |
| 219122 | 7/1924 | United Kingdom | 219/223 |

*Primary Examiner*—Gerald P. Tolin
*Assistant Examiner*—Bernard Roskoski
*Attorney, Agent, or Firm*—Weinstein & Sutton

[57] ABSTRACT

An electric hair singer is provided for removing split ends from hair and includes a housing having a passageway formed therein with a comb element and heating element disposed at one end of the passageway. At the other end of the passageway a fan motor is provided for producing a vacuum effect in the passageway to draw the split ends of hair through the comb element and against the heating element to be singed. In addition, means are provided for adjusting the vacuum effect within the passageway. In a preferred embodiment of the invention, the hair singer is combined with a hair dryer, with the hair singeing elements being disposed at one end of the passageway and the heating coil for the hair dryer disposed adjacent the other end of the passageway. In this manner, the fan motor which produces the vacuum effect for the hair singer also operates to blow air through the passageway of the hair dryer.

7 Claims, 4 Drawing Figures

HAIR SINGER AND HAIR DRYER

FIELD OF THE INVENTION

The present invention relates generally to hair treating devices, and specifically to an improved electric hair singer which employs a vacuum effect to singe the split ends of hair and may also be incorporated with a hair dryer and share a common fan motor.

BACKGROUND OF THE INVENTION

As is well known in the hair cutting and styling field, when hair is cut, split ends form along the strands of hair. In the newer hair styles which are being developed, such split ends produce an unsightly halo effect about the person's hair. Accordingly, it has long been desired to provide simple and safe ways of removing such split ends to provide hair styles which have a generally smooth appearance free of split ends.

In the past, there have been a number of different types of devices for singeing hair which typically include a comb-like element in combination with a heating element. However, these types of devices are not suitable for singeing split ends, as they did not include means for separating the split ends to be singed from the strands of hair which were not to be singed. In addition, in the prior art, a number of different types of devices have also been provided to singe hair including hot curling irons and the like. Of course, such devices also have the drawback of affecting the strands of hair not to be singed, as well as the split ends.

Accordingly, there is a need for a hair singeing device for removing the split ends from strands of hair which accomplishes this by separating the split ends from the strands of hair so that only the split ends are singed without affecting and/or damaging the strands of hair. It would also be desirable to provide such a device which is inexpensive and easy to handle.

Accordingly, it is broadly an object of the present invention to provide hair singeing apparatus which overcomes one or more of the aforesaid problems. Specifically, it is within the contemplation of the present invention to provide an improved hair singeing apparatus which includes means for separating the split ends of hair to be singed from the strands of hair so as to avoid damaging and/or affecting the hair which is not to be singed.

It is a further object of the present invention to provide an improved hair singer in combination with a hair dryer so that they both share a common fan motor which produces a suction effect for the singer and produces an air blowing effect for the hair dryer.

SUMMARY OF THE INVENTION

Briefly, in accordance with the principles of the present invention, an improved electric singer is provided for removing split ends of hair from strands of hair. The hair singer includes a housing having a longitudinally-extending passageway formed therein, with an opening formed at one end of the passageway. A comb element is disposed at the end of the passageway adjacent the opening for coming the hair to be treated, and a heating element is disposed within the passageway, just behind the comb element, for singeing the split ends of hair as the hair is being combed. In addition, a fan motor is provided within the passageway for producing a vacuum effect within the passageway to draw in or suck in the split ends of hair through the comb element and against the heating element to be singed. In this manner, the split ends to be singed are separated from the strands of hair which are not to be effected, and the split ends are effectively singed by the heating element. The device of the present invention is completely safe, since it will only singe the hair which extends through the comb element and against the heating element.

In one embodiment of the invention, means are provided on the housing of the hair singer for adjusting the vacuum effect within the passageway. The adjustment means include a pair of relatively rotatable plates, each having holes formed therein for adjusting the size of the air passageways through which air is conducted into the fan motor.

In a preferred embodiment of the present invention, the passageway of the hair singer includes a removable filter disposed therein for preventing any of the hair which enters the passageway from being sucked into the fan motor.

In an alternative embodiment of the present invention, the hair singer is combined in a housing with a hair dryer, and the housing includes a longitudinally-extending passageway formed therein. The hair singeing heating element and comb element are disposed at one end of the passageway for singeing hair, and a second heating element or heating coil is disposed adjacent the other end of the passageway for drying hair. In addition, a fan motor is disposed substantially centrally within the passageway for producing a vacuum in the passageway between the fan motor and the hair singer and for blowing air out through the passageway from the fan motor to the hair drying elements. In addition, means are provided for controlling the heating elements of the hair singer and hair dryer, as well as the fan motor.

Advantageously, in such an arrangement, the same fan motor is shared by both the hair singer and hair dryer so that a compact and economical device is provided for performing both hair singeing and hair drying functions.

BRIEF DESCRIPTION OF THE DRAWINGS

Further objects, features, and advantages of the present invention will become apparent upon the consideration of the following detailed description of presently-preferred embodiments, when taken in conjunction with the accompanying drawings, wherein.

DETAILED DISCUSSION OF PREFERRED EMBODIMENTS OF THE INVENTION

Figure 1:
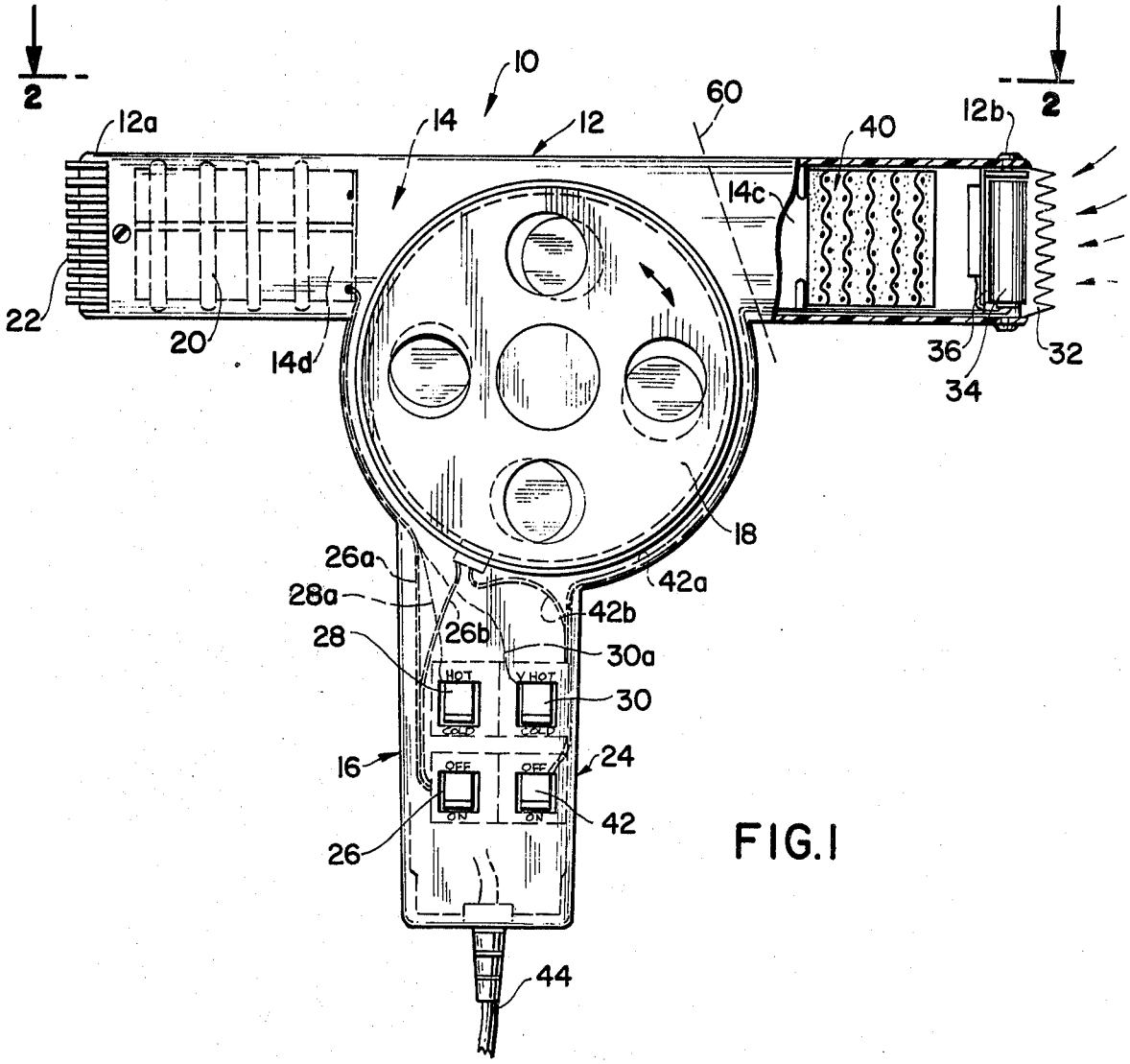
FIG. 1 is a side elevational view of the hair singer and hair dryer combined in the same housing, with portions of the housing broken away for purposes of clarity.
Figure 2:
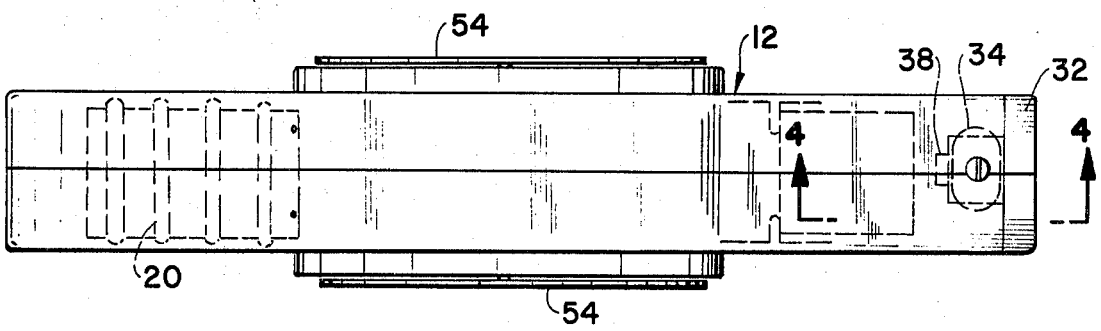
FIG. 2 is a top plan view of the device shown in FIG. 1.

Referring now to FIG. 1, there is shown the hair singer of the present invention combined into the same housing with a hair dryer, the entire construction generally being designated by the reference numeral 10. The device 10 includes a housing 12 having a longitudinally-extending passageway 14 extending from one end of the housing 12*a* to the other end of the housing 12*b*. In addition, the housing 12 includes a handle portion 16 so that the housing 12 forms a generally T-shaped configuration. Within the housing 12, and at the point where the handle 16 joins the passageway 14, a fan motor 18 is suitably mounted therein. The fan motor may be of the type found in conventional hair dryers and mounted within the housing 12 in the same manner. However, in the present arrangement, the fan motor 18 is mounted and rotates in a direction such that it blows air along passageway 14 in the direction of end 12*a* and draws air in through passageway 14 from end 12*b*. Accordingly, it will be understood that a vacuum or suction effect is produced in passageway 14*c* of the housing which extends between end 12*b* and the fan motor 18. In addition, air is blown along portion 14*d* of passageway 14 which extends between the fan motor 18 and the end 12*a*.

As is well known in conventional hair dryers, a suitable heating coil 20 is mounted within passageway 14*d* and is suitably secured to the housing 12. In addition, as is also well known in the art, a suitable protective grille 22 is mounted on the end of the housing 12*a* and is suitably connected to housing 12. In addition, as is also well known in conventional hair dryers, a control arrangement 24 is provided on handle portion 16. For example, the heating coil 20 and fan motor 18 are turned on and off by a switch 26 connected to heating coil 20 by suitable leads 26*a* and to fan motor 18 by a suitable lead 26*b*. In addition, control switches 28, 30 are electrically connected by suitable leads 28*a*, 30*a* to heating coil 20 to control the degree to which the heating coil is energized and to vary the heat produced. Such heating coils and the controls therefor are well known in the prior art and need not be described in further detail.

Considering now the hair singeing aspects of the present invention, it will be noted that at the end 12*b* of passageway 14*c*, there is a comb-like element 32 suitably mounted on the end of housing 12 having comb teeth about ¾" long. Mounted just behind comb 32 is a hair singeing heating element 34 which is mounted in a suitable support bracket 36 connected to housing 12 by suitable screws or the like. The heating element 34 may take the form of a circular heating bar which is electrically heated by suitable electrical connections to be explained. For example, the heating element may be a 2.5 watt, 120 volt Thunderbolt 26 heating element. In addition, the support bracket 36 for mounting the heating element 34 is formed of a suitable heat-resistant material, such as porcelain or Teflon. In this manner, the supporting element and enclosure 36 protect the housing 12, which preferably is formed of plastic, from the heat produced by heating element 34.

Also mounted on support bracket 36 is a conventional thermostat 38 which will operate to turn the heating element 34 on and off to maintain its temperature within a desired range. In addition, a removable filter 40 is mounted within passageway 14*c* for catching any hair which is drawn past the heating element 34 towards the fan motor 18. The filter may be of the screen type or charcoal. In this manner, the filter 40 prevents the fan motor from becoming clogged with hair and other debris. Preferably, filter 40 is removable so that it can be replaced when necessary.

As shown in FIG. 1, a control switch 42 is provided on handle 16 and is connected by electrical leads 42*a* to heating element 34 and is connected by electrical leads 42*b* to fan motor 18. Accordingly, as will be understood, control switch 42 operates heating element 34 and fan motor 18 of the hair singer independent of the control switch 26 which operates to control heating element 20 and fan motor 18 of the hair dryer. Electrical power is supplied to the control switches, the fan motor, and the electrical heating elements by an electrical cord and plug 44, partially shown in FIG. 1.

Figure 3:
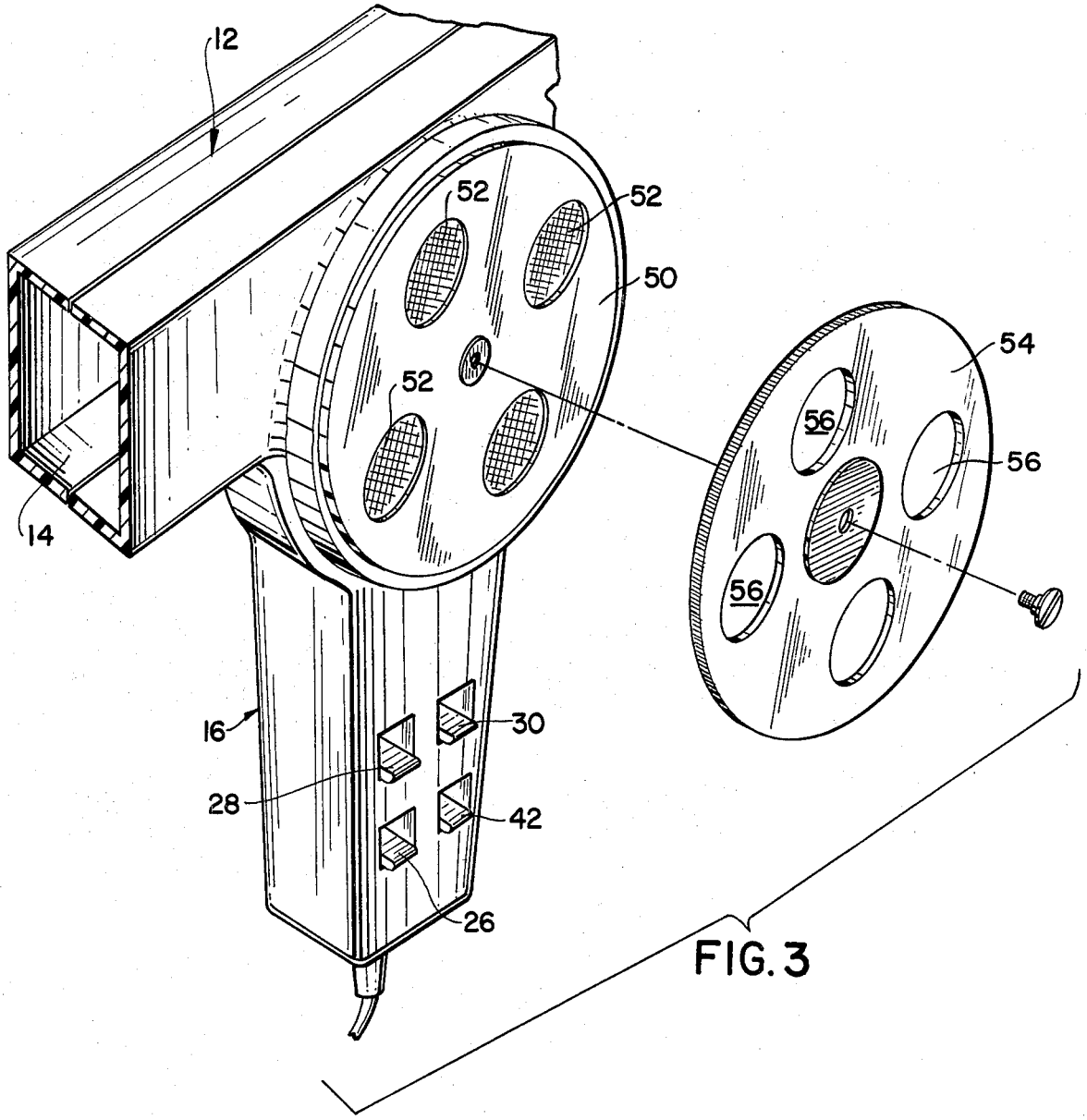
FIG. 3 is an enlarged perspective view of a portion of the device shown in FIG. 1, with one of the plates for adjusting the fan motor being shown disassembled from the housing.
Figure 4:
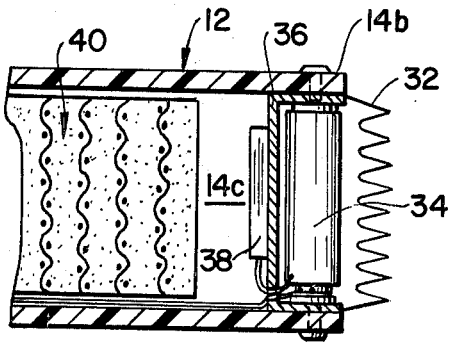
FIG. 4 is a partial side elevational view of the interior of the housing of the hair singer of the present invention illustrating in detail the arrangement of the filter, heating element, and comb element.

In FIG. 3, the arrangement for adjusting the air flow to the fan and motor 18 is shown in detail. Preferably, the housing wall 12 has a portion thereof which forms a plate 50 formed with a plurality of holes 52 which allow air to pass into fan motor 18. Rotatably mounted on housing 12 adjacent plate 50 is a plate 54 which is also provided with a plurality of holes 56. Accordingly, by rotating plate 54 relative to housing plate 50, the degree to which holes 52 and 56 overlap each other can be regulated to thereby control the size of the air passageways through which air passes into the housing 12 and passageway 14. In this manner, the suction or vacuum effect produced in passageway 14*c* can be regulated and controlled to the desired extent. A similar plate arrangement is provided on the other side of housing 12. It has been found that the air passageways should be closed when singeing very coarse hair to produce the greatest suction, and approximately half open for singeing medium hair, and approximately two-thirds open for singeing fine hair (less suction needed).

A brief description of the operation of the device of the present invention will now be provided. When it is desired to use the device 10 as a hair singer, control switch 42 is actuated and thereby turns on fan motor 18 to produce a suction effect in passageway 14*c* and also operates to energize heating element 34. The user then passes the comb 32 over the hair to be singed. As a result, the suction effect draws the split ends in through the comb element 32 and into engagement with the heating element 34, so that these split ends are singed and removed. However, the strands of hair themselves are maintained in position and under tension by comb element 32 so that the strands of hair which are not to be singed are not drawn through the comb 32 and into engagement with the heating element 34. Therefore, in accordance with the present invention, only the split ends to be singed are drawn in through the comb and into engagement with the heating element 34 by the suction effect within passageway 14*c* which operates to separate the split ends from the strands of hair which are not to be singed. It should also be noted that the suction produced in passageway 14*c* operates to cool off the heating element 34 and the surrounding elements so that there is no excessive heat buildup which makes the present device extremely safe to operate.

When it is desired to use the device 10 as a conventional hair blower, switch 26 is actuated which operates to independently energize fan motor 18 and heating coil 20. In addition, switches 28, 30 can be operated to control the degree of heat produced by heating element 20. The fan motor will blow air through passageway 14*d* and past heating element 20 to produce hot blowing air for drying of the hair. This arrangement is well known in the prior art and need not be discussed in further detail. However, it should be noted that in accordance with the present invention, the adjustment plate 54 can be regulated to also control the blowing effect of the hair dryer when it is being used, as well as the suction effect of the hair singer when it is being used.

In view of the foregoing, it will be appreciated that there has been provided in accordance with the present invention a hair singeing apparatus which includes suction producing means for drawing only the split ends of the hair into the hair singeing device and thereby avoids damaging and/or singeing the hair strands which are not to be singed. Also, in accordance with the present invention, the hair singer may be incorporated into the same housing as a hair dryer and thereby shares the same fan and motor to provide a compact and portable hair dryer and hair singer. It is also within the contemplation of the present invention that the hair singer can be of a modular type construction so that it would simply plug into a hair drying device and would be removably connected thereto when it is desired to use the hair singer. The dotted lines 60 in FIG. 1 show the point at which a plug-in type of arrangement can be provided on housing 12 for plugging in the hair singeing portion of the device to a hair dryer.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A combined hair singer and hair dryer, comprising:

a housing including a passageway formed therein extending from a first end of said housing to a second end of said housing;

a first heating element disposed at the first end of said housing for drying hair;

a second heating element and a comb element disposed at the second end of said housing for singeing hair;

a fan disposed in said passageway between said first and second heating elements for producing a vacuum effect in said passageway between said fan and said second heating element and for blowing air out through said passageway from said fan to said first heating element; and means for controlling said first and second heating elements and said fan.

2. The device of claim 1, wherein said comb element is connected to the second end of said housing, and said second heating element is disposed within said passageway behind said comb element so that the split ends of hair are drawn through the comb element and against said second heating element to be singed.

3. The device of claim 1 further including means on said housing for adjusting the vacuum within said passageway.

4. The device of claim 3, wherein said adjusting means includes a pair of relatively rotatable plates, each having holes formed therein for adjusting the vacuum in said passageway.

5. The device of claim 1, wherein a filter is mounted within said passageway between said fan and said second heating element.

6. The device of claim 1, wherein said housing includes a handle for holding and manipulating said device.

7. The device of claim 1, wherein the second end of said housing containing said second heating element and said comb is detachable from the remainder of said housing.

* * * * *